US008727830B2

(12) United States Patent
Fleeton

(10) Patent No.: US 8,727,830 B2
(45) Date of Patent: May 20, 2014

(54) BRASSIERE WITH INFLATION /DEFLATION ASSEMBLY

(76) Inventor: Garth Fleeton, Paddington (AU)

( * ) Notice: Subject to any disclaimer, the term of this patent is extended or adjusted under 35 U.S.C. 154(b) by 266 days.

(21) Appl. No.: 12/989,420

(22) PCT Filed: Apr. 23, 2009

(86) PCT No.: PCT/AU2009/000505
§ 371 (c)(1),
(2), (4) Date: Dec. 7, 2010

(87) PCT Pub. No.: WO2009/129574
PCT Pub. Date: Oct. 29, 2009

(65) Prior Publication Data

US 2011/0065358 A1 Mar. 17, 2011

(30) Foreign Application Priority Data

Apr. 23, 2008 (AU) ..... 2008902005

(51) Int. Cl.
*A41C 3/00* (2006.01)

(52) U.S. Cl.
CPC . *A41C 3/0028* (2013.01); *Y10S 2/03* (2013.01)
USPC ..... 450/38; 450/54; 450/57; 2/DIG. 3

(58) Field of Classification Search
USPC ..... 450/38, 1, 54–57; 2/67, 267, 268, 2/DIG. 3
See application file for complete search history.

(56) References Cited

U.S. PATENT DOCUMENTS

| | | | | |
|---|---|---|---|---|
| 3,326,218 | A | 6/1967 | McAlpine | |
| 5,347,656 | A * | 9/1994 | Fabritz et al. | 2/67 |
| 5,833,515 | A * | 11/1998 | Shahbazian et al. | 450/38 |
| 6,302,760 | B1 | 10/2001 | Dai | |
| 6,461,221 | B1 * | 10/2002 | Stilwell et al. | 450/57 |

* cited by examiner

*Primary Examiner* — Gloria Hale
(74) *Attorney, Agent, or Firm* — Shalom Wertsberger; Salamar Innovations

(57) ABSTRACT

A brassiere comprising: breast cups for supporting a breast of a wearer; each said breast cups including at least one inflatable air envelope having at least one internal space which receives air from at least one air pump; connection means allowing communicating between a pump and the at least one inflatable envelope, such that when a pump is actuated, the at least one inflatable envelope is air inflated.

15 Claims, 7 Drawing Sheets

BRASSIERE WITH INFLATION /DEFLATION ASSEMBLY

BACKGROUND

The present invention relates to women's undergarments and more specifically to female support garments and more particularly to improvements in brassieres. The invention further relates to a brassier including an assembly which allows a wearer to inflate portions of the bra to selectively alter the shape of a wearer's breasts without artificial implants, padding, or other artificial supports. The invention further relates to an integrally attached assembly which allows pneumatic inflation of regions of a brassiere which oppose selected breast locations to locally load a breast at least one location to enable the user to selectively adjust breast shape to give an illusion of a user selected breast shape or increased breast size.

PRIOR ART

There are in existence numerous brassiere designs to accommodate the large variety of individual breast shapes and sizes. Breast presentation is an important aspect of a woman's appearance as dictated by the fashion industry. How an ideal breast should look or be presented is largely dictated by that industry, aesthetics, human activity and circumstances. Enhancement of breast size and shape can be a preoccupation with women either to increase self esteem or to increase a perception that they are attractive to the opposite sex. To this end women have resorted to a wide variety of methods to alter the shape and appearance of breasts to conform to dictates of fashion and to appear more voluptuous in the latest dress fashions. Known methods to enhance breast shape and size include removeable brassiere inserts, padding, silicone implants and other elective surgical enhancements. Although fashion and image dictate acceptable or ideal breast presentation there are many women who although not victims of fashion, may require correction of breast disfigurement occasioned by injury, abnormal size of each individual breast or radical mastectomy resulting from breast cancer treatments. Women in that latter category may elect to use artificial breasts which can be fitted to the chest using an adhesive back wall. These artificial breasts are usually made from silicone and for all intents and purposes, mimic the weight of a real breast and also look real when hidden inside modest upper garments. These adhesive artificial breasts are used by women who have had total mastectomies leaving little or no original breast. Adhesive breasts may be used by women who have had single or double mastectomies. Even in a case where a mastectomy patient has had a full breast reconstruction using a tissue graft, a surgically manufactured replacement breast is not perfect and may require further enhancement using brassiere support, inserts, padding and the like.

The fashion industry seems to be united on the desirability of presenting breast cleavage as a result of which most of the enhancement methods incorporated into, integral with or used in conjunction with brassieres aim to meet this objective. Although there are many and various brassiere types available to enhance breast appearance, there is always room for improvement. Among the known brassieres are those which employ under wires that provide stiffness in brassiere cups to increase support underneath the breast. Other brassieres have altered cup shape to re distribute support loadings on the breast with the aim of enhancing cleavage or décolete as it is sometimes known. Yet another brassiere type includes integral inserts which are sewn in at strategic locations so the inserts impact on the breast to alter its shape. Usually these inserts are located in apposition to the underside of the breast and provide uplift again increasing décolleté. Although brassiere design has been dictated by fashion, since a brassiere is primarily intended to provide support for breasts attention must be paid to load distributions when a brassiere is in situ. Women with very large breasts can be handicapped by back pain if the brassiere used by such women is not fit for the purpose. For brassieres which include shoulder straps, ultimately breast load is transmitted to the shoulders via those straps. Heavy breasts can cause pain in the shoulders at the load point. This is exacerbated in the case where the brassiere design does not provide optimal breast support. For larger breasted women comfort is often more important than breast appearance.

One drawback with the known brassieres and particularly those that are designed to enhance breast presentation by altering shape, rather than just providing basic support, is that once on the wearer, the brassiere design dictates breast shape once and for all. Thus, the breasts can only appear in a particular way for a given brassiere design. In that case, should the user be displeased with the result, the only way to change shape is to change brassiere size or type until the desired breast shape and configuration is achieved. In the past the trend in brassiere design has been to achieve breast lift and separation. More recently the trend has been to provide brassieres which may lift but which also urge breasts in apposition to each other to enhance décolleté. Women alter their breast appearance depending upon the activity undertaken. For instance in the workplace comfort is likely to be the primary concern. However, for social occasions such as parties the more exposed breasts are the more important appearance becomes.

One type of bra used to create an illusion of larger breast size is the padded bra which is known by the trade mark name of Wonderbra. These bras lift the breasts and add shape to them with extra padding. Some more innovative push up bras use silicone inserts or water sacks to imitate the fullness of natural breasts. They are said to lift and separate creating a full cleavage look on breasts of all sizes. The bra features include a plunge-front underwire and cushioned back straps. The plunge and pad design is said to add an entire cup size to the bust line. Bra cups have been designed for a sleeker look under clothes.

Another known bra is a strapless push-up plunge bra having a precision-angled underwire, removable cookies and silicon-backed elastic to provide slip-free, stay-put wearing. This bra can be worn with or without straps. Bra sizes are typically 32-38A, 32-38B, 32-38C, and 32-38D.

Another type of bra is the underwire push up air bra which is a lightly lined bra with removable air pillows in the cups aiming to create a natural-looking cleavage with maximum comfort. Another known bra is the seam free T shirt bra which includes padding with gel inserts. This bra looks and feels natural and is intended to mould to the wearer's shape so it feels like the wearers own bust. The intention of this bra is to creates attractive cleavage whilst providing support and comfort. Another bra known as the seamless underwire bra which provides cleavage and without compromise to support. This bra has a hidden underwire.

There is a long felt want in the brassiere industry to provide a brassiere which allows a user the versatility to alter breast shape and presentation beyond one fixed shape and presentation as was the case in the prior art. There is also a long felt want in the industry to provide a brassiere which has multiple degrees of freedom of expansion in multiple directions so the user can control breast shape and as required, change the appearance of a breast. To date there is no brassiere that conveniently provides a user with wide versatility to change breast shape by altering the shape of a brassiere before use or while in use.

INVENTION

The present invention provides a brassier including an assembly which allows a wearer to inflate portions of the bra to selectively alter the shape of a wearer's breasts without artificial implants, padding, or other artificial supports. The invention further provides an integrally attached assembly which allows pneumatic inflation of regions of a brassiere which oppose selected breast locations to locally load a breast at predetermined locations to enable the user to selectively adjust breast shape and to give an illusion of increased breast size.

In its broadest form the present invention comprises:

a brassiere comprising: breast cups for supporting a breast of a wearer; each said breast cups including at least one inflatable air envelope having at least one internal space which receives air from at least one air pump;

connection means allowing communicating between a pump and the at least one inflatable envelope, such that when a pump is actuated, the at least one inflatable envelope is air inflated.

In another broad form the present invention comprises:

a brassiere having at least spaced apart breast cups, a midriff band and fastening means, the brassier further comprising an assembly including a pump, at least one inflatable envelope and means communicating between the pump and the at least one inflatable envelope, wherein the pump is manually operable to enable pneumatic inflation of the at least one envelope to a size selected by the user, wherein each said inflatable envelope displaces at least a portion of a breast thereby altering the shape of the breast.

The shape of the breast is altered to an extent commensurate with the extent of inflation of the at least one envelope. The displacement of the breast takes place at a breast location which is in apposition with the inflatable envelope.

Preferably there are at lest two inflatable envelopes integrally formed in either cup of the brassiere.

In another broad form the present invention comprises:

an assembly which enables adjustment to a shape of a brassiere cup, the assembly comprising; at least one inflatable air envelope located in or on the brassiere cup having at least one internal space which receives air from at least one pump; means allowing communicating between the at least one pump and the at least one inflatable envelope, such that when the at least one pump is actuated, the at least one inflatable air envelope receives air and inflates.

In another broad form the present invention comprises:

an assembly which allows manual inflation of at least a portion of a brassiere having at least spaced apart breast cups, a midriff band and fastening means; the assembly including a pump, at least one inflatable envelope and communication means between the pump and the at least one inflatable envelope or bladder, wherein the pump is manually operable to enable pneumatic inflation of the at least one bladder to a size selected by the user, wherein each said inflatable bladder upon inflation displaces at least a portion of a breast thereby altering the shape of the breast.

According to a preferred embodiment each bladder includes a valve allowing selective deflation of the bladder.

In another broad form the present invention comprises:

a brassiere comprising spaced apart breast cups for supporting a breast of a wearer the, a midriff band and fastening means for securing the midriff band about the torso of a wearer, the brassier further comprising an assembly including a pump, at least one inflatable envelope and means communicating between the pump and the at least one inflatable envelope, wherein the pump is manually operable to enable pneumatic inflation of the at least one envelope to a size selected by the user, wherein each said inflatable envelope displaces at least a portion of a breast thereby altering the shape of the breast.

The present invention provides an alternative to the known prior art and the shortcomings identified. The foregoing and other objects and advantages will appear from the description to follow. In the description reference is made to the accompanying representations, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying illustrations, like reference characters designate the same or similar parts throughout the several views.

The following detailed description is, therefore, not to be taken in a limiting sense, and the scope of the present invention is best defined by the appended claims.

DETAILED DESCRIPTION

The examples referred to herein are illustrative and are not to be regarded as limiting the scope of the invention. While various embodiments of the invention have been described herein, it will be appreciated that these are capable of modification, and therefore the disclosures herein are not to be construed as limiting of the precise details set forth, but to avail such changes and alterations as fall within the scope of the description.

Figure 1:
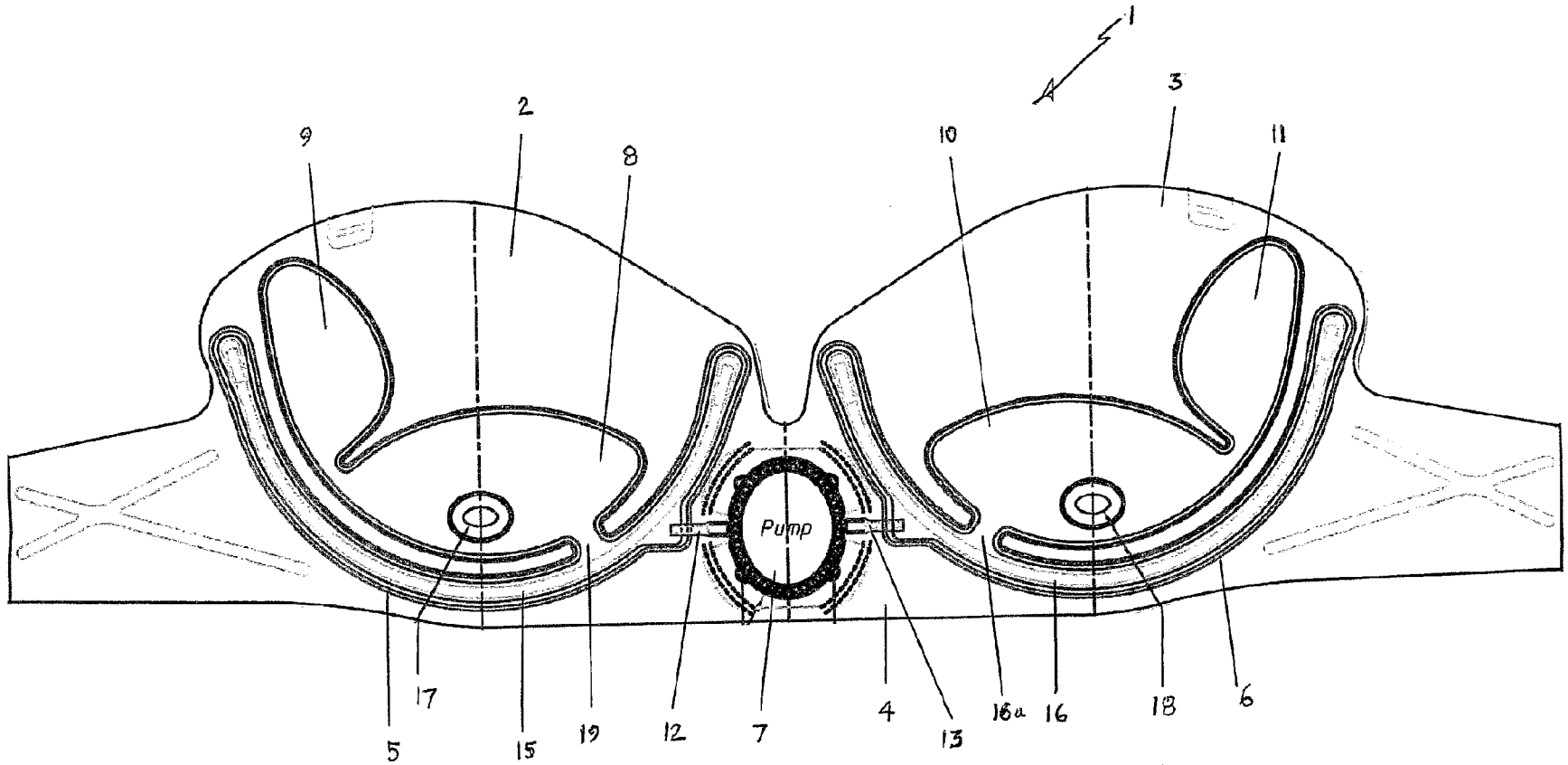
FIG. 1 shows a front elevation view of a stylized brassiere according to one embodiment.

FIG. 1 shows a front elevation view of a stylized brassiere 1 (hereinafter abbreviated to bra) according to one embodiment. Brassiere 1 comprises spaced apart breast cups 2 and 3, a midriff band 4 and fastening means (not shown) to enable fastening of bra 1. Bra 1 further comprises an under wire 5 in cup 2 and under wire 6 in cup 3. Underwires are commonly found in brassieres to impart added rigidity to the periphery of the cups and to increase support. The invention to be described below according to a preferred embodiment, may be employed in a wide variety of bra's and is not limited to its application in an underwire bra. Brassier 1 further comprising an assembly which allows selective inflation and deflation of parts of the bra cups. The inflation assembly includes a pump 7 which is operatively connected to inflatable envelopes or bladders 8 and 9 in cup 2 and inflatable bladders 10 and 11 in cup 3. Interconnecting pump 7 are air delivery passages 12 and 13 which communicate with the bladders. According to the embodiment shown, passage 12 feeds bladders 8 and 9 via distribution envelope 15 and passage 13 feeds bladders 10 and 11 via distribution envelope 16. Pump 7 is preferably manually operable to enable pneumatic inflation of the bladders to a size selected by the user. Each inflatable bladder displaces at least a portion of a breast thereby altering the shape of the breast both locally and remotely depending upon the degree of inflation. Initial displacement of the breast takes place at a breast location which is in apposition with the inflatable bladders. According to a preferred embodiment, there are at least two inflatable bladders integrally formed in both cups 2 and 3 of the brassiere. In an alternative embodiment, one cup has bladders but the other cup does not. This may for instance be required in the case where one breast has undergone trauma to one breast causing an alteration in the breast shape or full or partial mastectomy as a result of cancer. As shown in FIG. 1, each of bladders 8, and 10 are adapted with control valves respectively valves 17 and 18 which regulate the passage of air to and from the respective bladders. Valves 17 and 18 can be a known type such as a duck bill valve or standard two way valve which allows passage of air in and out of the bladders 8 and 10. Preferably the valves are adapted with a manual release which enables a user to independently operate each valve release air as required.

Air enters bladder 8 via inlet 19 and air enters bladder 10 via inlet 16*a*.

As shown in FIG. 1, cup 2 has bladder 9 laterally disposed and bladder 8 disposed in a region which presents to the underside of a breast. Bladder 9 would impact upon inflation on the outer lateral breast region urging the breast in a general direction towards the opposite breast. Bladders 8 and 9 can be operated independently or jointly depending upon the users breast presentation requirements. Lateral load placed on the breast by bladder 9 would urge the breast centrally increasing décolleté. At the same time, the breast can undergo lift under the action of underside bladder 8. Similar adjustment capability is available in cup 3 by inflation or deflation of bladders 10 and 11. Thus, both breasts can be adjusted symmetrically or asymmetrically as required depending upon the user requirements. It will be appreciated that with this versatility integrated into bra 1, that a user has wide capacity to adjust breast configuration as required. Specifically, the breasts can be configured using this bra to adapt to dress requirements, whether it be for evening wear, sport, work wear or other form of attire. The bra can also accommodate different sized breasts so as to make the breasts look symmetrical.

Figure 2:
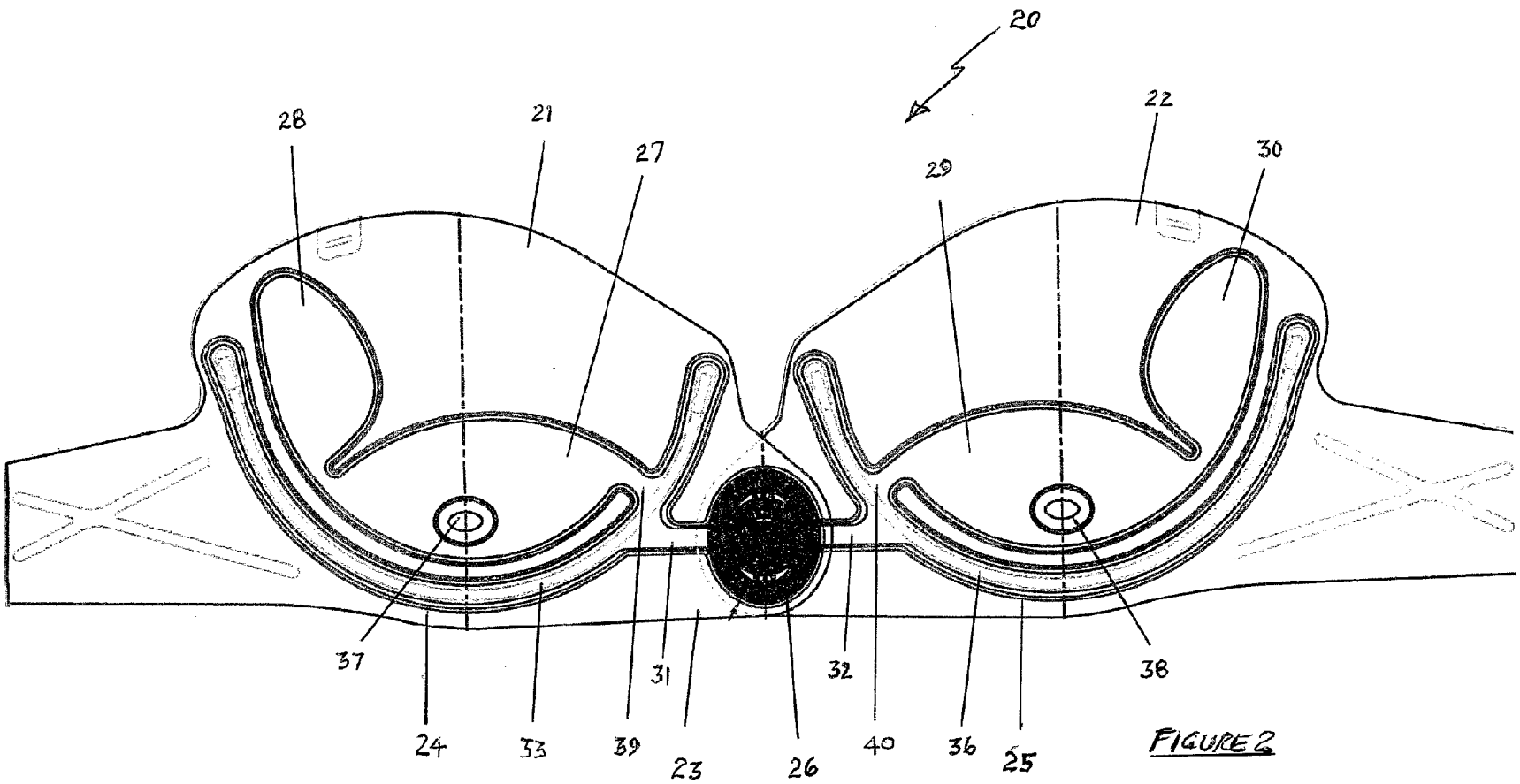
FIG. 2 shows a front view of a brassiere according to an alternative embodiment including a clasp pump which enables joining of the brassiere at a midriff.

FIG. 2 shows a front view of a brassiere according to an alternative embodiment including a clasp pump which enables joining of the brassiere at a midriff.

Brassiere 20 comprises spaced apart breast cups 21 and 22, a midriff band 23. Bra 20 further comprises an under wire 24 in cup 21 and under wire 25 in cup 22. Brassier 20 further comprising an assembly which allows selective inflation and deflation of parts of the bra cups. The inflation assembly includes a pump 26 which is operatively connected to inflatable envelopes or bladders 27 and 28 in cup 21 and inflatable bladders 29 and 30 in cup 22. Extending from pump 26 are air delivery passages 31 and 32 which communicate with the bladders. According to the embodiment shown, passage 31 feeds bladders 27 and 28 via distribution envelope 33 and passage 32 feeds bladders 34 and 35 via distribution envelope 36. Pump 26 is preferably manually operable to enable pneumatic inflation of the bladders to a size selected by the user. As before, each inflatable bladder displaces at least a portion of a breast thereby altering the shape of the breast both locally and remotely depending upon the degree of inflation. Initial displacement of the breast takes place at a breast location which is in apposition with the inflatable bladders.

According to a preferred embodiment, bladders 27 and 28 may comprises segments with separate geometry but are in air communication. One bladder may used to effect all inflation or a segmented bladder as shown in FIGS. 1 and 2 may be used to more effectively distribute loading on the breast generated by the inflatable bladders. Preferably the bladders are contained within the fabric of the brassiere. Each of bladders 27, and 29 are adapted with control valves respectively valves 37 and 38 which regulate the passage of air to and from the respective bladders. Valves 37 and 38 can be a known type such as a duck bill one way valve or standard two way valve which allows passage of air in and out of the bladders 37 and 38. Preferably the valves are adapted with a manual release which enables a user to independently operate each valve release air as required.

As shown in FIG. 2 air from pump 26 enters bladder 27 via inlet 39 and bladder 29 via inlet 40. Air may be released from bladder 27 and 28 via valve 37 and from bladder 29 and 30 via valve 38.

Bladders 27 and 28 and 29 and 30 operate as described for the bladders in bra 1 of FIG. 1. Thus, both breasts can be adjusted symmetrically or asymmetrically as required depending upon the user requirements.

Figure 3:
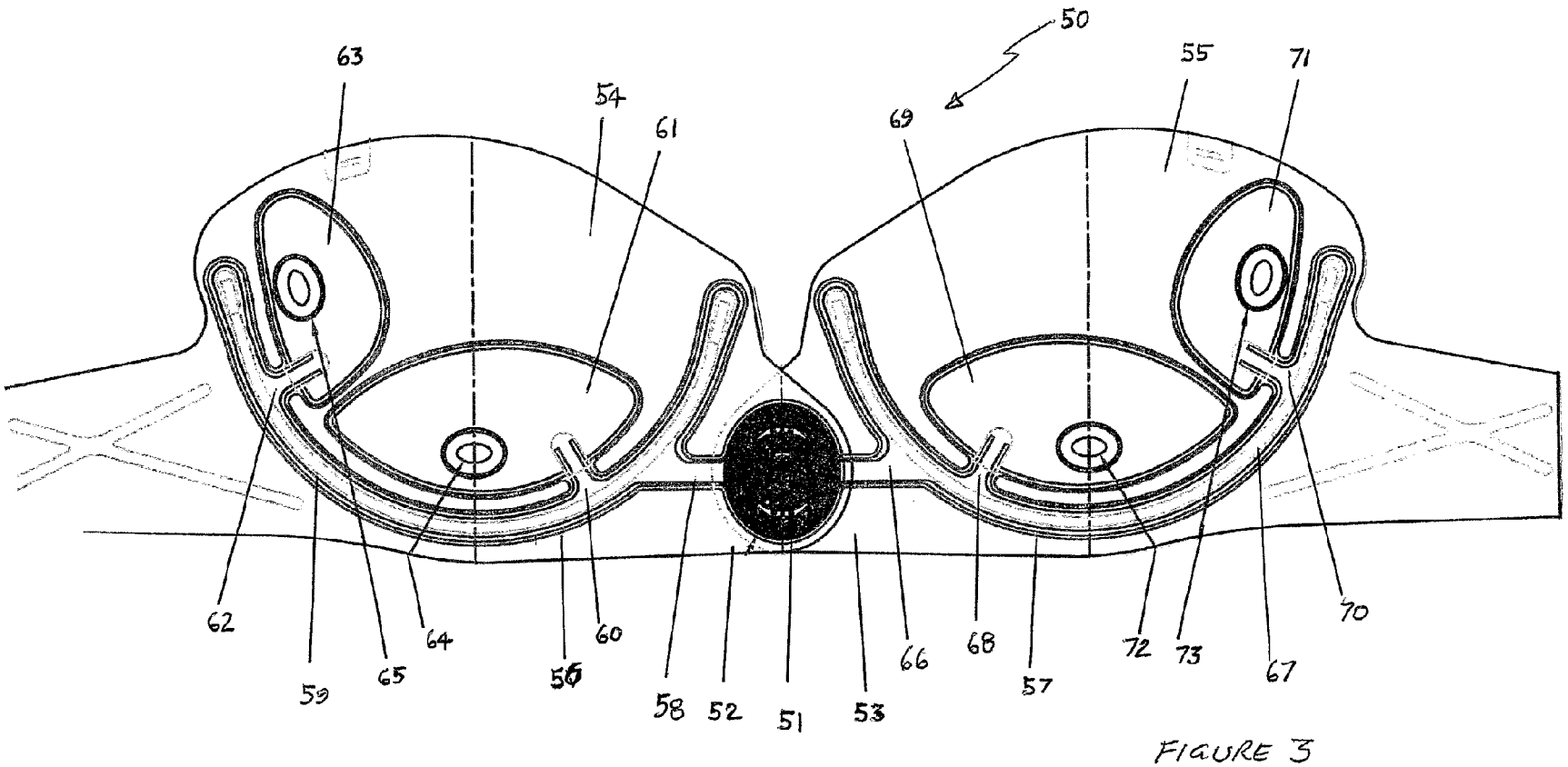
FIG. 3 shows a front view of a brassiere including a clasp pump which enables joining of the brassiere at a midriff and including an alternative air distribution regime.

FIG. 3 shows a front view of a brassiere 50 including a clasp pump 51 which enables joining of the brassiere at midriff portions 52 and 53. Bra 50 includes an alternative air distribution and release regime to that described with reference to FIGS. 1 and 2.

Brassiere 50 comprises spaced apart breast cups 54 and 55 including an under wire 56 in cup 54 and under wire 57 in cup 55. Brassier 50 further comprises an assembly which allows selective inflation and deflation of parts of the bra cups 54 and 55. Pump 51 includes bladder inlet tube 58 which feeds pressurised air to distribution bladder 59. Air is then delivered via inlet 60 to bladder 61 and via inlet 62 to bladder 63. Bladder 61 includes air release valve 64 and bladder 63 includes air release valve 65. Pump 51 includes bladder inlet tube 58 which feeds pressurised air to distribution bladder 59. Air is then delivered via inlet 60 to bladder 61 and via inlet 62 to bladder 63. Bladder 61 includes air release valve 64 and bladder 63 includes air release valve 65.

Pump 51 also includes bladder inlet tube 66 which feeds pressurised air to distribution bladder 67. Air is then delivered via inlet 68 to bladder 69 and via inlet 70 to bladder 71. Bladder 69 includes air release valve 72 and bladder 71 includes air release valve 73.

As before, each inflatable bladder displaces at least a portion of a breast thereby altering the shape of the breast both locally and remotely depending upon the degree of inflation. Initial displacement of the breast takes place at a breast location which is in apposition with the inflatable bladders. Preferably the valves are adapted with a manual release which enables a user to independently operate each valve.

This arrangement allows the user separate capacity to adjust bladder compartments individually and provides increased capacity for fine adjustment of loading applied to the breast for breast reshaping. Although the embodiments shown in FIGS. 1, 2 and 3 have one pump assembly operatively connected to all bladders it will be appreciated that according to one embodiment, each bladder be operated by its own separate pump. Also, each cup may be adapted with a plurality of bladders as shown or one bladder only. Furthermore, each bladder may have its own release valve or there may be one release valve for all bladders. In an alternative embodiment one valve can be adapted to operate one or more bladders. Bladders can be restricted to one cup or distributed symmetrically or asymmetrically across two cups. An asymmetric distribution may for instance occur for uneven breasts or in the case of a partial mastectomy.

Figure 4:
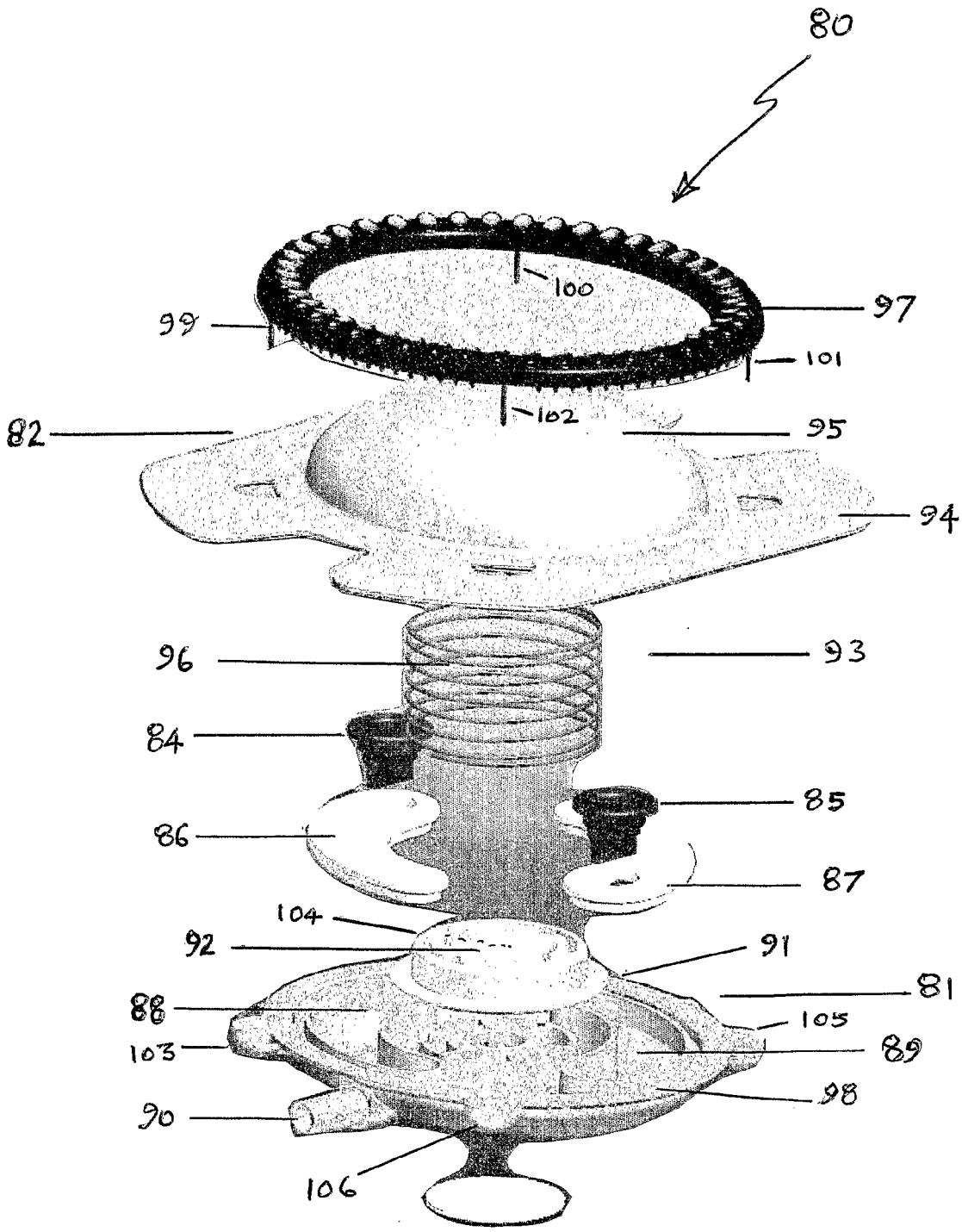
FIG. 4 shows an exploded view of a pump assembly according to one embodiment.

FIG. 4 shows an exploded view of a pump assembly 80 according to one embodiment. Preferably pump assembly 80 is operable by squeezing or pressing from the front against the backing of the chest of a wearer. Pump 80 according to the embodiment shown comprises a body having first and second general hemispherical parts 81 and 82 having respective opposing equator regions 83 and 84. Part 81 which acts as a manifold and 82 define an internal space 93 housing valves 84 and 85 which engage respective sealing covers 86 and 87. Covers 86 and 87 respectively close passages 88 and 89. Passage 88 is in communication with outlet tube 90 and passage 89 is in communication with outlet tube 91 (obscured). Assembly 80 further comprises a regulator one way valve 92 which allows entry of an air supply into space 93 when pump 80 is charged. Part 81 includes a flange 94 which allows engagement of the pump with a brassiere and also allows midriff portions of the brassiere such as midriff portions 52 and 53 as described in FIG. 3 to be clasped by the flange. Part 81 also includes a diaphragm 95 which an operator can depress against the bias of restoring spring 96. Pump 80 operates between a first state in which air is introduced into space 93 and a second state in which diaphragm 95 is depressed or squeezed against biasing spring 96 forcing air in space 93 into valves 84 and 85 and then into tubes 90 and 91 for delivery of air to inflatable bladders in a brassiere as described earlier. Collar 97 locks flange 94 of part 82 to flange 98 of manifold 81. Collar 97 is locked via engagement between locking pins 99, 100, 101 and 102 with corresponding housings 103, 104 (obscured), 105 and 106.

Figure 5:
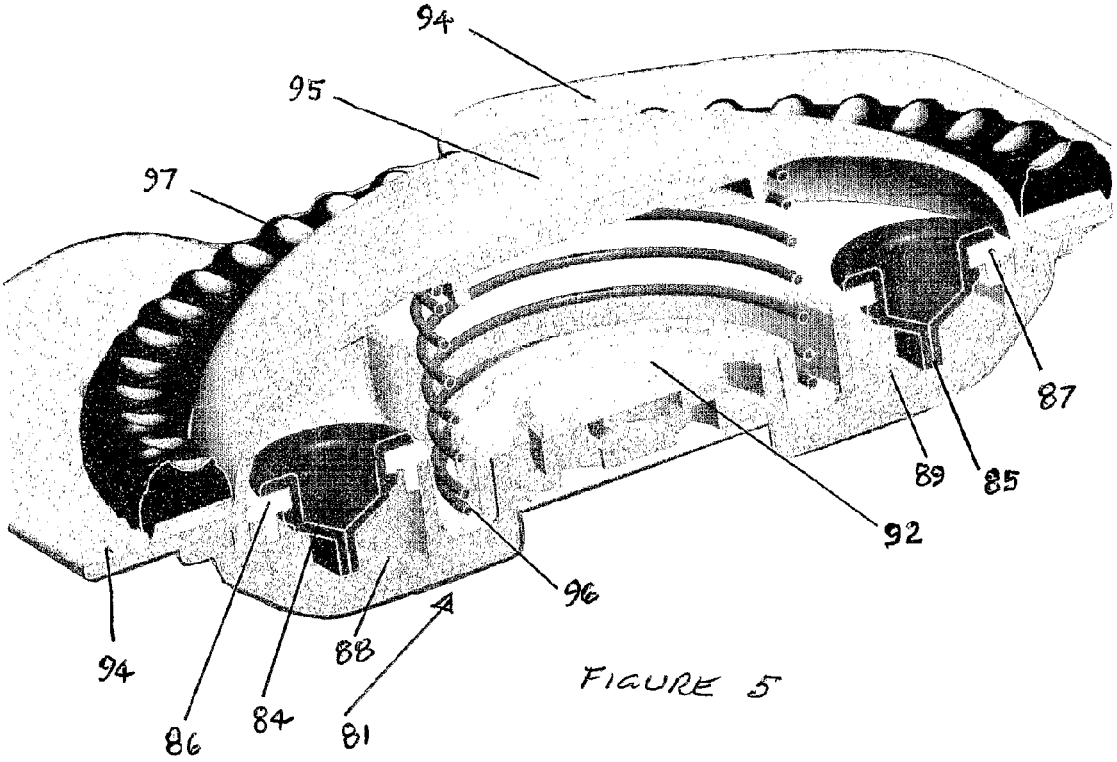
FIG. 5 shows a cross sectional view taken on one axis of a pump assembly according to one embodiment.
Figure 6:
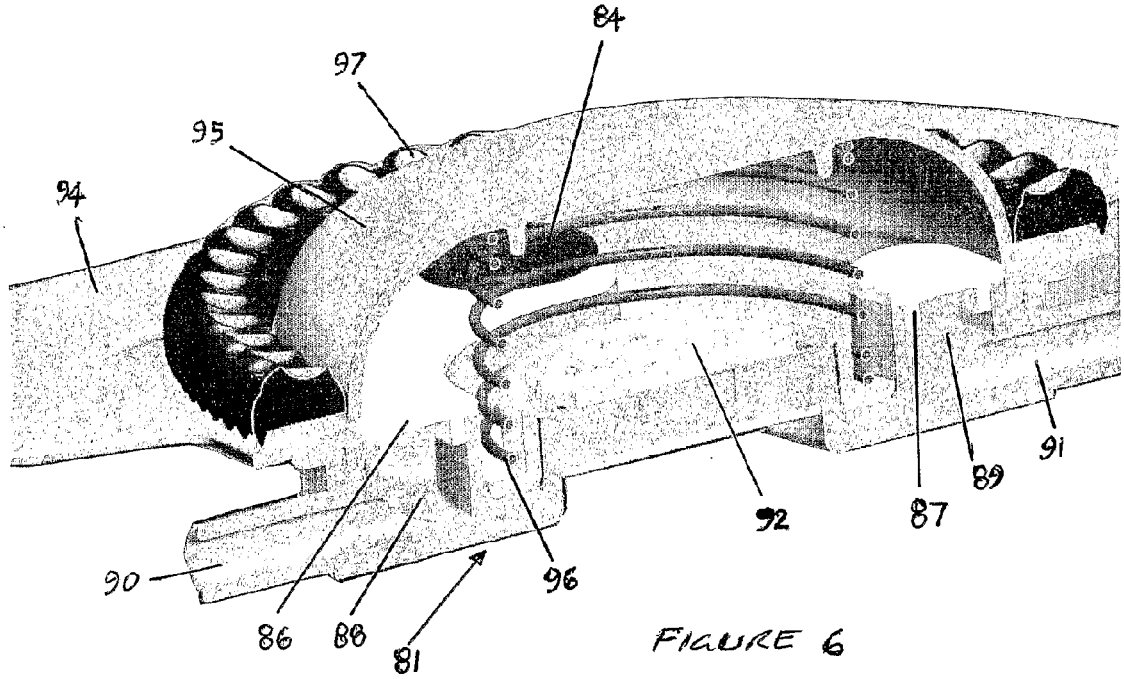
FIG. 6 shows a cross sectional view taken on another axis of a pump assembly according to one embodiment.

FIG. 5 shows with corresponding numbering a cross sectional view taken on one axis of the assembled pump assembly 80. One way duck bill valves 84 and 85 feed pressurised air to channels 88 and 89. FIG. 6 shows a cross sectional view taken on another axis of a pump assembly 80. Air from passage 88 is delivered to outlet tube 90 and air from passage 89 is delivered to tube 91 thereby inflating bladders in a brassiere to which pump 80 is attached as described earlier.

Figure 7:
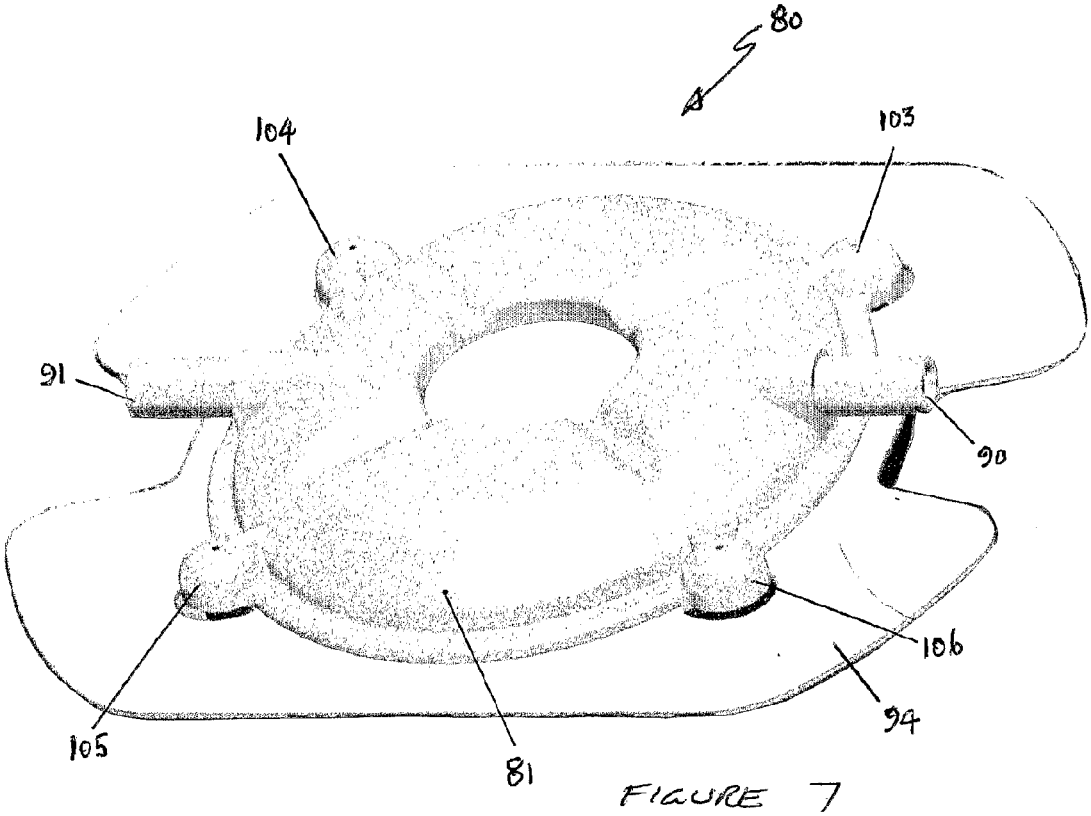
FIG. 7 shows a perspective view of the pump of FIG. 4 from an underside.
Figure 8:
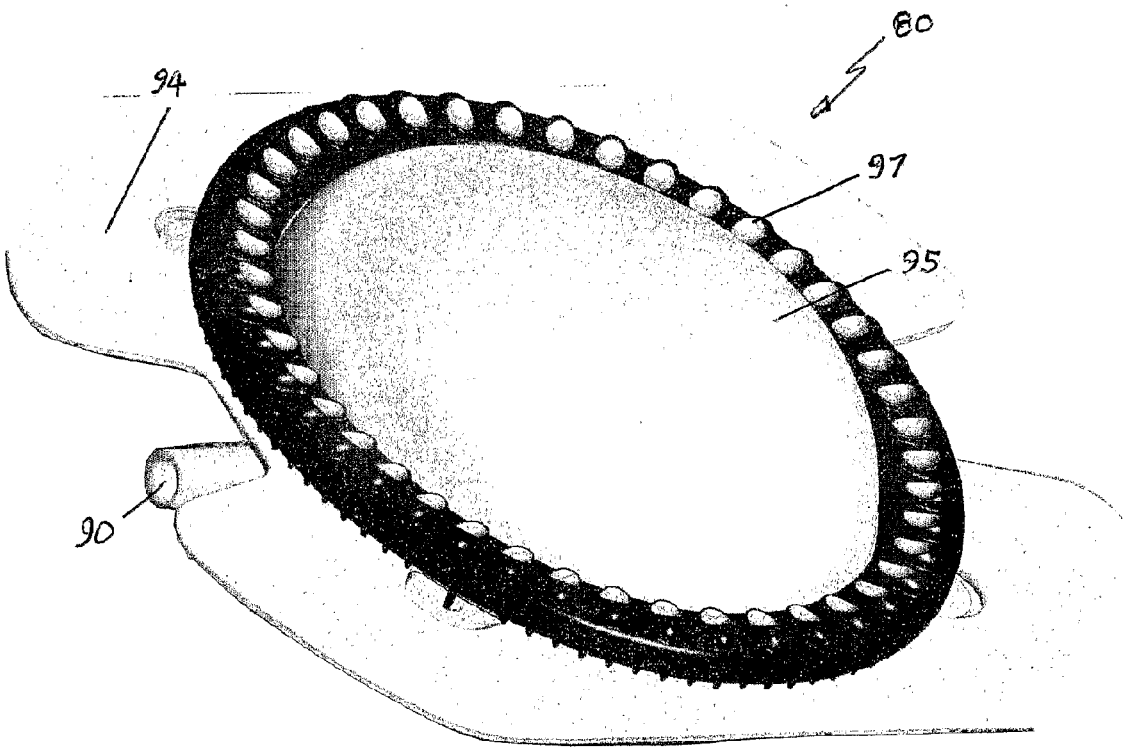
FIG. 8 shows a perspective view of the pump of FIG. 4 from a top side view.

FIG. 7 shows with corresponding numbering a perspective view of the pump 80 of FIG. 4 fully assembled from an underside; and FIG. 8 shows with corresponding numbering from a top side view of the pump 80 of FIG. 7.

Figure 9:
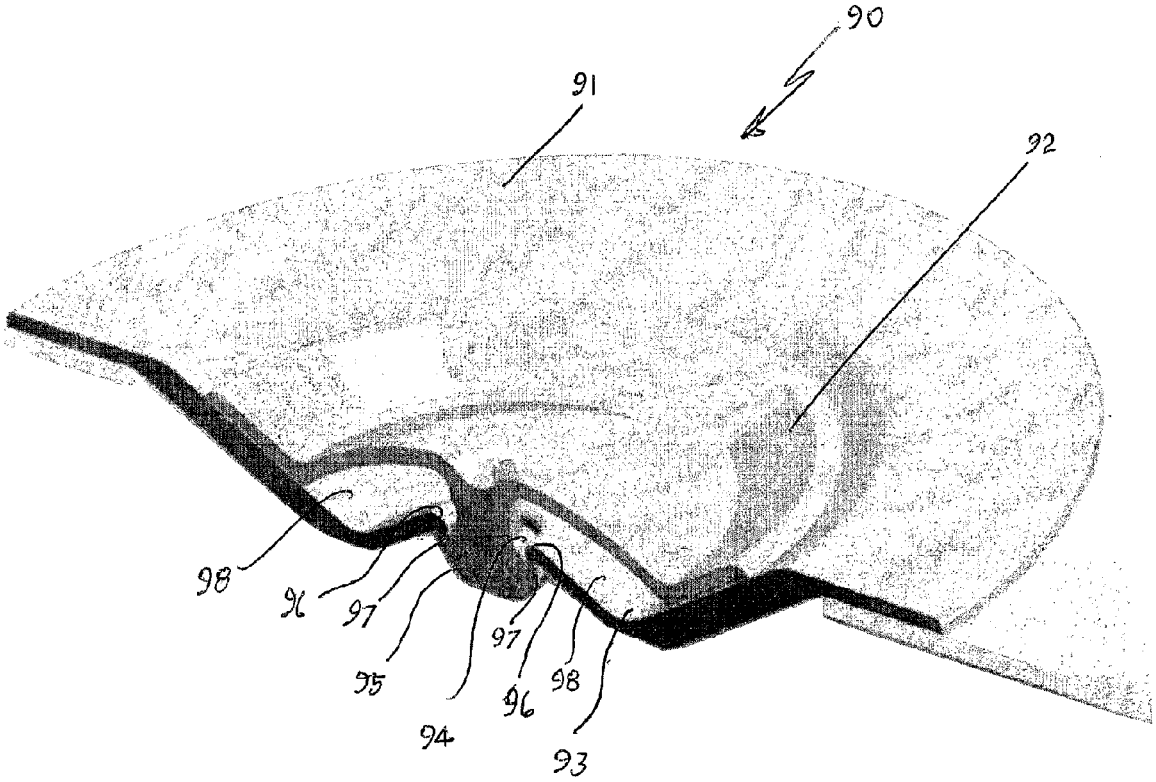
FIG. 9 shows a cross sectional view through an air release valve according to one embodiment.

FIG. 9 shows a cross sectional view through a release valve assembly 90 according to one embodiment. Valve assembly 90 comprises a valve body 91 and valve 92. Valve body 91 includes an inner recess 93 which terminates in an opening 94 which receives and retains therein shut off gate 95. Valve 92 moves between a first state in which gate 95 abuts rim 96 via shoulder 97 of gate 95 to close and seal the valve and a second state in which valve is pressed by a user allowing shoulder 97 to extend away from rim 96 to allow release of air through opening 94. Air migrates away from valve 92 via passage 98 thereby releasing air from inflatable bladders. The above described valve assembly is one embodiment of release valves 17 and 18 or 64 and 65 referred to in FIGS. 1 and 3 respectively.

Various materials may be adopted for the inflatable bladders pump and air supply lines from the pump to bladders. Plastics are preferred with an example of bladder material being polyurethane.

It will be recognised by persons skilled in the art that numerous variations and modifications may be made to the invention broadly described herein without departing from the overall spirit and scope of the invention.

The claims defining the invention are as follows:

1. A brassiere comprising: two breast cups for supporting a breast of a wearer; each said breast cup comprising a plurality of inflatable air envelopes each having at least one internal space which receives air from an air pump;

a connection allowing communicating between the pump and the plurality of inwardly inflatable air envelopes which are along with the pump disposed integrally with and supported in a space between a bra material defining an inner cup surface and an outer cup surface, such that when a pump is actuated, the at least one inflatable envelope is air inflated thereby exerting a displacement force on the breast to enable deformation thereof;

wherein, the connection which allows communications between the pump and the at least one envelope is at least one air valve;

wherein each breast cup comprises a primary envelope having a connection to said pump and which receives air for delivery to the primary envelope;

wherein the primary envelope has a wall arranged so that a series of inflatable individual air pockets are formed therein; and wherein the pump is manually operable to enable pneumatic inflation of the at least one envelope to a size selected by the user;

wherein the pump comprises opposing mutually engagable members which form a pump body; and wherein at least one of the engagable members comprises a displaceable wall which moves between a first state in which air is discharged from the pump and a second state in which a vacuum is created allowing air to be entrained into the pump.

2. A brassiere according to claim 1 further comprising a plurality of inflatable air envelopes formed by division of a main inflatable envelop into separate inflatable cells.

3. A brassiere according to claim 1 further comprising a midriff band and a fastener for securing the midriff band about the torso of a wearer.

4. A brassiere according to claim 1 further comprising at least one release valve for allowing escape of air from the air pockets.

5. A brassiere according to claim 4 wherein this the at least one release valve allows escape of air from all air pockets in the envelope.

6. A brassiere according to claim 1 wherein the individual air pockets are located in the brassiere cup so they each oppose a distal portion of the wearer's breast.

7. A brassiere according to claim 6 wherein the envelope air pockets are located so that on inflation, the air pockets displace a region underneath or at the sides of the breast.

8. A brassiere according to claim 7 wherein inflation of the envelope causes elevation and lateral displacement of the breast.

9. A brassiere according to claim 1 wherein the pump further comprises a spring bias which urges the displaceable wall to the second state.

10. A brassiere according to claim 1 wherein the pump has an outlet which engages the inlet of the envelope.

11. A brassiere according to claim 1 wherein the pump has a first passage, in which air exiting the pump passes, and a second passage, through which air entering the pump passes.

12. A brassiere according to claim 1 wherein the pump enables connection of one part of a midriff band to another part of a midriff band.

13. A brassiere according to claim 6 wherein the pump further comprises a collar which allows the pump to be detachably fitted to a midriff region of the brassiere.

14. A brassiere according to claim 1 wherein the pump comprises at least one one-way valve.

15. A brassiere according to claim 14 wherein there is one relief valve for each inflatable pocket to enable release of air.

* * * * *